United States Patent [19]

Holman

[11] Patent Number: 5,018,240

[45] Date of Patent: May 28, 1991

[54] CARPET CLEANER

[75] Inventor: Andrew P. Holman, Poole, England

[73] Assignee: Cimex Limited, Dorset, England

[21] Appl. No.: 515,455

[22] Filed: Apr. 27, 1990

[51] Int. Cl.[5] ..... A47L 5/30

[52] U.S. Cl. ..... 15/349; 15/347; 15/352; 15/384

[58] Field of Search ..... 15/347, 348, 349, 352, 15/384

[56] References Cited

U.S. PATENT DOCUMENTS

| | | | |
|---|---|---|---|
| 2,266,075 | 12/1941 | Replogle | 15/349 X |
| 3,184,775 | 5/1965 | Downey et al. | 15/349 X |
| 3,482,276 | 12/1969 | Fillery | 15/349 |
| 3,906,585 | 9/1975 | Mattsson | 15/349 |
| 4,490,882 | 1/1985 | Wells | 15/391 X |

*Primary Examiner*—Chris K. Moore

*Attorney, Agent, or Firm*—Nixon & Vanderhye

[57] ABSTRACT

A carpet cleaner capable of collecting larger items of litter such as cigarette ends, cigarette packages, paper as well as smaller items of particulate material such as dust and dirt. The cleaner comprises brush rollers for picking up all the debris etc and airflow causes larger items to accumulate in accumulation receptacle and smaller items in a collection unit.

16 Claims, 5 Drawing Sheets

CARPET CLEANER

FIELD OF THE INVENTION

This invention relates to a carpet cleaner.

BACKGROUND TO THE INVENTION

Known carpet cleaners incorporate various configurations and arrangements of brushes and vacuum systems. However difficulties are encountered with the removal of cigarette ends, cigarette packets, pieces of paper, leaves and other larger items of debris or litter insofar as they are not always picked up and, if they are, are capable of creating a blockage inside the cleaner thereby preventing the passage of dirt and dust particles to a collection bag.

It is an object of the present invention to provide a carpet cleaner which is less likely to suffer from the above disadvantage and is capable of picking up most larger items of litter.

SUMMARY OF INVENTION

In accordance with the invention a carpet cleaner comprises a hollow housing capable of being moved across the carpet surface; intake means through which dust, dirt, debris, litter and other particulate matter may be ingested; exhaust means; brush means in the vicinity of the intake means for brushing up said dust, dirt, debris, litter and other particulate matter from the carpet surface; air flow creation means to induce air to enter through the intake means and exit through the exhaust means; accumulation means for accumulating larger items of debris, litter and other particulate matter entrained in the air flow; and collection means for collecting dust, dirt and other smaller items of particulate matter not accumulated in the accumulation means.

Preferably the brush means comprises a pair of contra-rotating brush rollers positioned side by side with axes parallel to one another and to the carpet surface and at right angles to the direction of movement of the cleaner, the arrangement being such that when the rollers rotate in use the dust, dirt, debris, litter and other particulate matter passes between the rollers generally upwardly from the carpet surface.

Preferably an intake member is connected to the collecting means and positioned adjacent to the intake means, near to and at the rear of the rear brush roller, and adjacent the carpet surface, said intake member ingesting dust, dirt and other smaller items of particulate matter to be entrained in the air flow and passed to the collection means.

In one form of the invention the collection means is located downstream of the accumulation means, and the air flows through the accumulation means and then through the collection means.

In another form of the invention the air flow creation means creates two air flows, the first air flow entraining mainly larger items of debris, litter and other particulate material to cause said larger items to enter the accumulation means, and the second air flow entraining dust, dirt and other smaller items of particulate matter not entrained in the first air flow to cause said smaller items to enter the collection means.

BRIEF DESCRIPTION OF THE DRAWINGS

Two embodiments of the invention will now be described by way of example only with reference to the accompanying drawings of which.

DESCRIPTION OF THE PREFERRED EMBODIMENTS

Figure 1:
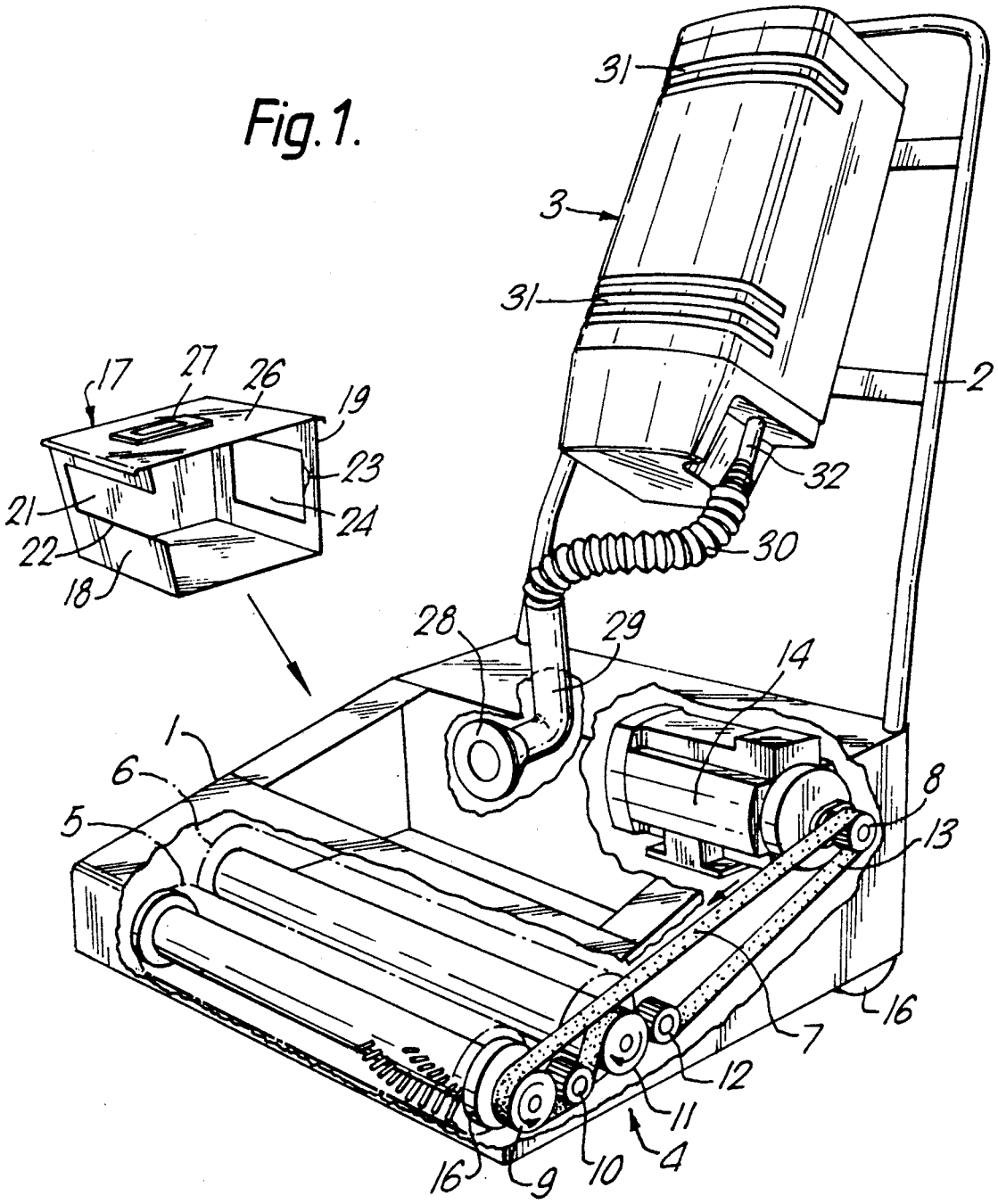
FIG. 1 shows a partly exploded, partly diagrammatic perspective view of a first embodiment of the invention.
Figure 2:
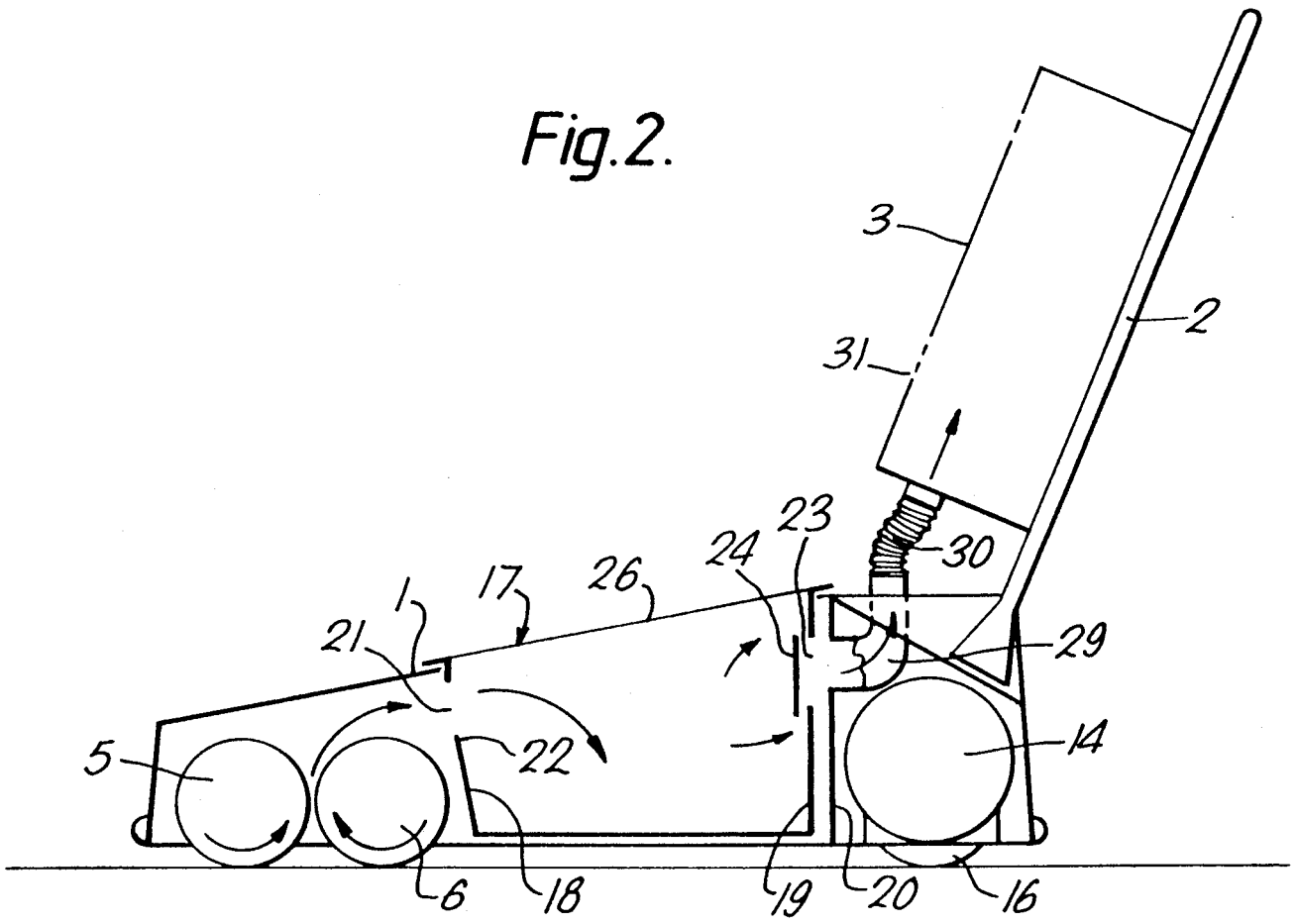
FIG. 2 shows a simplified cross-sectional view of the first embodiment shown in FIG. 1.

As shown in FIGS. 1 and 2 the cleaner of the first embodiment comprises a generally hollow housing 1, a handle 2 and a vacuum unit 3 mounted on the handle.

An electric motor 14 is mounted within and towards the rear of the fabricated steel housing and drives, through a toothed belt and pulley system 4 at the side of the housing 1 a pair of contra-rotating brush rollers 5, 6 positioned at the front of the housing and with the lower parts of the rollers 5, 6 protruding beneath the housing 1 and in brushing contact with the carpet surface.

As can be seen in the drawing, the top run 7 of the toothed belt 13 in the belt and pulley system 4 passes from the top of a toothed drive pulley wheel 8 mounted in the central shaft of the electric motor 14 in a forwards direction to the front pulley wheel. The belt then passes over the top of and then under a front toothed pulley wheel 9 mounted on the central spindle of the front brush roller 5, over a first idler roller 10, located behind the front pulley wheel 9, over a rear toothed pulley wheel 11 mounted on the central spindle of the rear brush roller 6, under a second idler roller 12 located behind the rear pulley wheel, and back to the drive pulley wheel 8. Arrows in the drawings indicate the direction of movement of the belt 13 and the direction of rotation of the pulley wheels 9 and 11.

The front brush roller 5 has a slightly larger diameter than the brush roller 6. The rollers are also provided with end fittings (not shown) which enable them to be removed and replaced after repair or cleaning in the same arrangement and without being able to interchange rollers.

Two front support wheels 15 made for example of nylon, (only one shown) for the housing are mounted in a freely rotatable manner in the central spindle of the front brush roller 5, one wheel on each side thereof. Two rear-tired support wheels 16 (only one shown) of larger diameter than the front support wheels, are freely rotatably mounted close to the rear of the housing 1, and beneath the handle 2.

Between the pair of rollers 5, 6 and the motor 14 is a compartment in which is normally located a litter collecting box 17 having a front wall 18 positioned close to the rear brush roller 6 and a rear wall 19 positioned close to a bulkhead 20 within the housing and adjacent the motor 14. The top part of the front wall 28 is provided with a rectangular inlet aperture 21 which extends across most of the transverse width of the housing and for a length which is equal to or greater than the width of the brush rollers 5, 6. The front wall slopes downwardly and rearwardly at a small angle to the vertical and the bottom edge 22 of the aperture 21 is approximately horizontally level with the top of the rear roller 6. The box 17 is also provided with a circular exit aperture 23 located towards the top of the rear wall 19. A square baffle plate, which may be provided with small perforations, 24 is mounted within the box a small distance from the rear wall so as to cover the exit aperture 23 but leave a small gap around its periphery. Alternatively or additionally the aperture 23 may be covered by a coarse wire mesh filter (not shown). The exit aperture 23 is positioned in general alignment with a circular hole 25 in the bulkhead 20. A grommet 28 sealingly connects one end of a pipe 29 having a 90° bend with the hole 25. The lid 26 of the box 17 is rectangular and slightly larger than the rectangular aperture at the top of the compartment which receives the box. The box is thus supported by its lid within the compartment. The lid 26 is provided with a handle 27 by means of which it may be lifted out of the housing.

The pipe 29 extends backwards from the bulkhead 20 and upwards through the top surface of the housing 1 and connects to the bottom end of a flexible tube 30 which in turn is connected to the vacuum unit 3 by means of a spigot 32 projecting from the lower part of the body in which the unit is housed.

The vacuum unit 3 is generally conventional and comprises a motor, a fan unit and collecting bag none of which are shown in the drawings. The unit body is generally formed with vents 31 through which air is exhausted to the surrounding atmosphere.

The cleaner is also provided with a cable and plug by means of which the motors are electrically connected to the mains supply, and other conventional switches and controls by means of which the motors may be switched on and off, or their speed varied, thus varying the speed of rotation of the brush rollers 5, 6 and the speed of the fan thus varying the flow rate of air flowing through the cleaner. Means (not shown) may also be provided to raise and lower the housing 1 relative to the carpet surface. This may comprise means for raising and lowering the rear support wheels 16 simultaneously relative to the housing by means of a cable control connected to a lever mounted on the handle 2. Alternatively a single castor wheel may be mounted at the front of the housing, the castor wheel capable of being raised or lowered as required.

The position of the vacuum unit 3 on the handle 2 is chosen so that its weight almost counter-balances the weight of the housing 1 and its contents when the cleaner is rocked backwards or forwards on the rear support wheels 16 thus facilitating use by an operator.

In use the cleaner is controlled by an operator pushing or pulling it across the surface of the carpet to be cleaned and varying the speeds of the motors and height of the housing 1 by readily accessible controls mounted on the handle 2. The motor driven fan in the vacuum unit 3 causes air to be drawn into the housing 1 around the two brush rollers 5, 6, through the inlet aperture 21 in the collecting box 17, out of the exit aperture 23, through the pipe 29 and tube 30 and into the vacuum unit where it passes through the dust collecting bag before flowing out of the vents 31 to atmosphere. The contra-rotating brush rollers 5, 6 are caused to rotate in the direction shown by the arrows in the drawings, brush up dirt dust, debris, litter, leaves and other particles. Under the combined influence o the rollers and the air flow all this matter passes upwards between the two rollers and through the inlet aperture 21 into the collecting box. The larger items such as cigarette ends, pieces of paper, leaves, fall to the floor of the box 17 whilst the lighter dust and dirt particles are carried in the air stream though the exit aperture 23, pipe 29 and tube 30 to the collecting bag on the vacuum unit. The baffle 24 in front of the exit aperture 23, and/or the coarse mesh (if provided) prevent the larger items such as pieces of paper from passing into the pipe 29, tubing 30 or vacuum unit 3 and thereby causing a blockage which would impair the dust and dirt extraction efficiency of the vacuum unit 3.

Both the collecting box 17 and the collecting bag may be removed readily when full, emptied, cleaned and returned to the cleaner.

The cleaner may also be used advantageously when cleaning a carpet with a dry powder. In this technique, powder is first of all distributed over the carpet surface by hand and then brushed into the tufts of the carpet by passing the cleaner over it but with the motors switched off. After a suitable time period the cleaner is passed over the carpet again, but this time with the motor 14 driving the brush rollers 5, 6 switched on. The bulk of the powder is picked up and then falls into the litter box together with larger items of debris. Finally the cleaner is operated with both motors switched on to achieve complete cleaning of the carpet.

Figure 3:
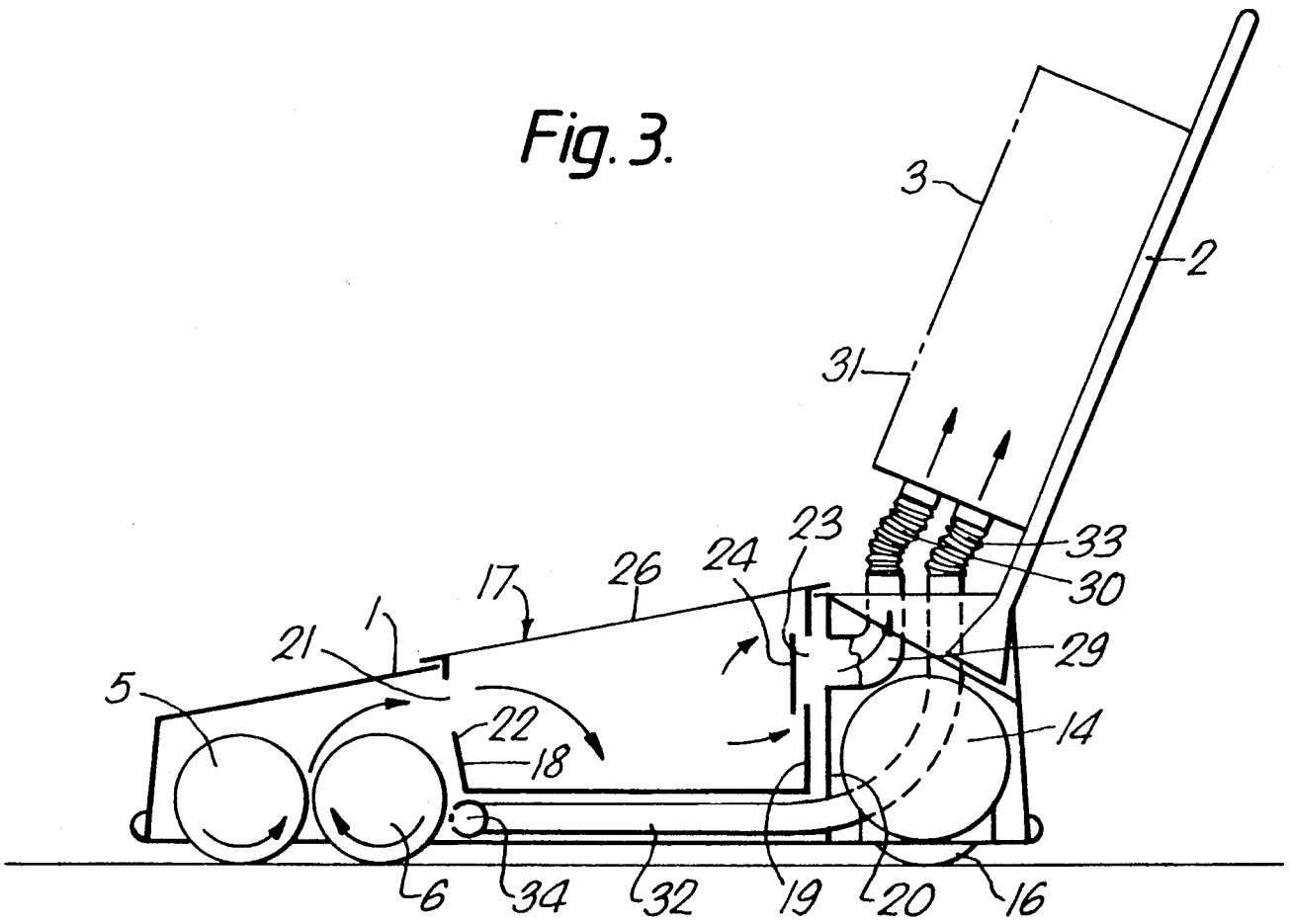
FIG. 3 shows a simplified cross-sectional view of a modified version of the embodiment shown in FIGS. 1 and 2.

In a modification of the first embodiment shown in FIG. 3 the cleaner is additionally provided with a hollow cylindrical intake tube 34 positioned immediately to the rear of the rear brush roller 6 and close to the carpet surface. The axis of the intake tube, which is approximately equal in length to the length of the brush rollers 5 and 6, is parallel to the brush roller axes. The tube is formed with a plurality of apertures adjacent the rear brush roller through which dust, dirt and other smaller items of particulate material may pass.

The tube is connected via a pipe 32 passing underneath the box 17, through the bulkhead 20, to a flexible hose 33 fastened between the top of the housing 1 at the underside of the vacuum unit 3.

In use of the cleaner the air flow creating means in the vacuum unit causes an additional air flow from the rear of the rear brush roller 6 through the intake tube 34, along the pipe 32 and hose 33 to the vacuum unit 3. Dirt, dust and other small items of particulate material not entrained in the air flow passing from the top of the two brush rollers 5, 6 and in to the box 17 via aperture 21 fall between the rear of the rear brush roller 6 and the front wall 28 of the box 17 to be ingested through the apertures in the intake tube 17. The additional air flow causes this dirt, dust etc. to be carried to the vacuum unit 3 where it is collected in the collecting bag. The additional air flow also causes particles not carried upwards between the rollers to be picked up directly from the carpet surface immediately behind the rear brush roller 6.

Figure 4:
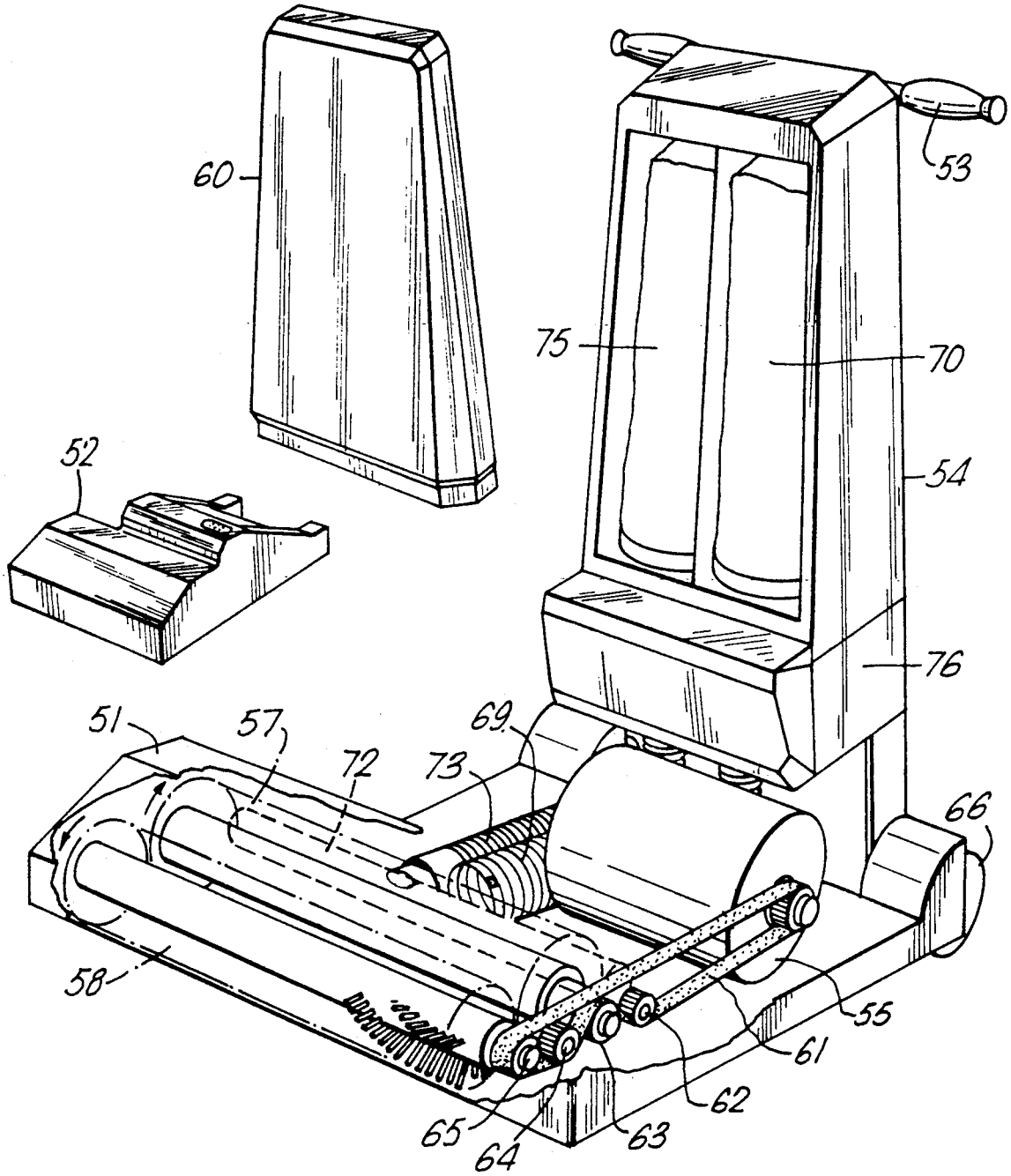
FIG. 4 shows a partly exploded, partly diagrammatic perspective view of a second embodiment of the invention.
Figure 5:
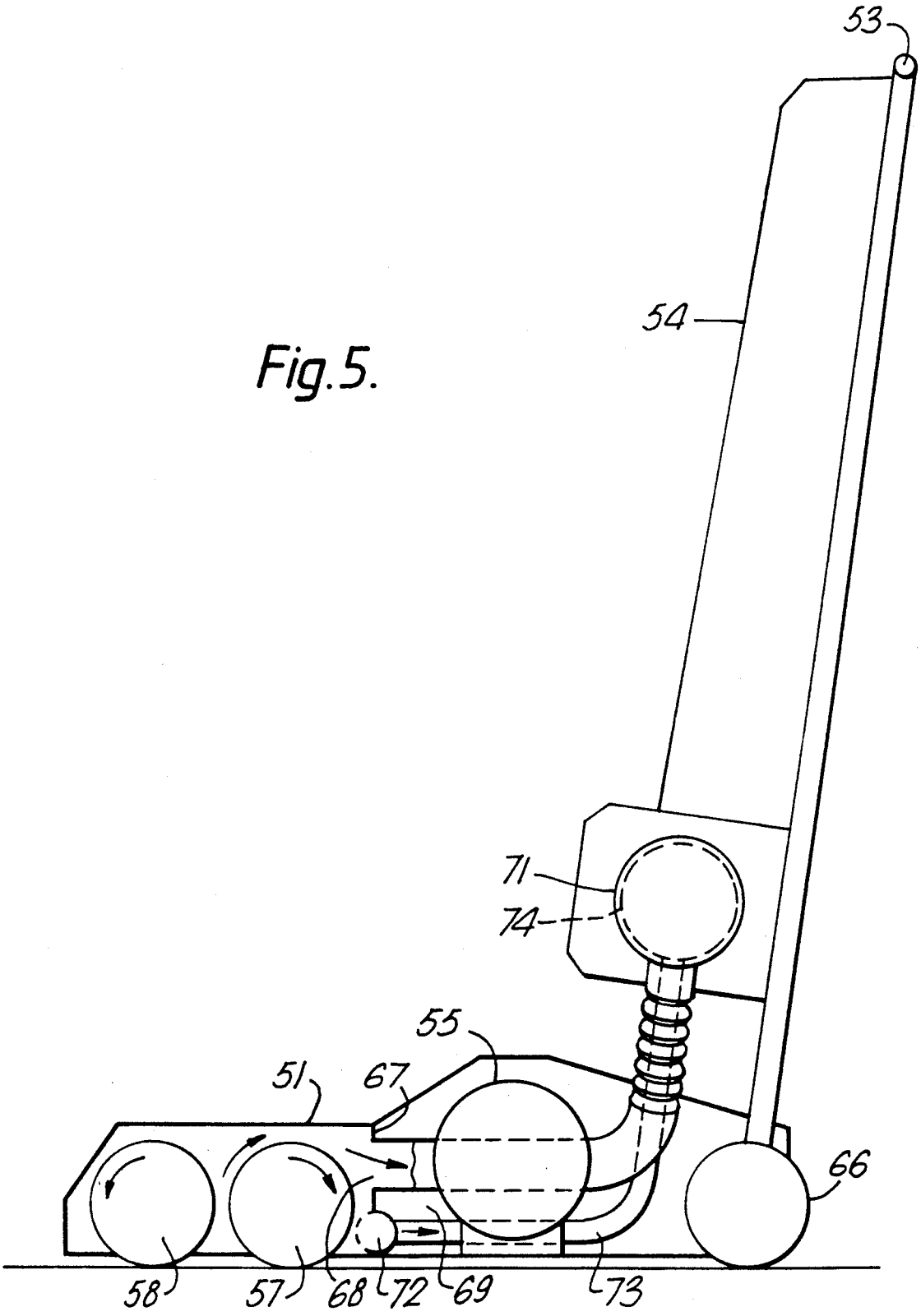
FIG. 5 shows a simplified cross-sectional view of the second embodiment shown in FIG. 4.

The second embodiment of the invention, a carpet cleaner also capable of picking up larger items of debris such as cigarette ends, pieces of paper and leaves as well as dust and dirt is shown in FIGS. 4 and 5. As shown this cleaner comprises a generally hollow housing 51 having a separable housing cover 52 (shown in FIG. 4 on a reduced scale), a handle 53 and a vacuum unit 54 with a replaceable vented unit cover 60, mounted on the handle.

An electric motor 55 is mounted within the fabricated steel housing, and drives through a toothed belt and pulley system 56 a pair of contra-rotating brush rollers 57, 58 positioned at the front of the housing and with the lower parts thereof protruding beneath the housing 51 and in brushing contact with the carpet surface. The brush rollers 57, 58 are driven by the electric motor 55 through a system comprising a toothed belt 61 and pulleys 62, 63, 64 and 65. The construction and arrangement of the brush rollers and their associated belt and pulley system is the same as the arrangement of the first embodiment and therefore will not be described in detail again here.

The housing is supported on two front support wheels (not shown) and two rear support wheels 66 (only one shown), the latter being directly beneath the upright handle 53. This arrangement of wheels is generally the same as that of the first embodiment.

Directly behind the rear brush roller 57 is a bulkhead 67 which forms the rear wall of a compartment in which the two roller brushes are located. This bulkhead is formed with a large aperture 68 through which large items such as litter, debris, leaves, as well as smaller particles of dust and dirt may be drawn in to a relatively large diameter pipe 69 and thence to a litter accummulation bag 70 in the vacuum unit under the influence of the air flow created by a first motor driven pump 71. The diameter of the pipe 69 and the power of the pump 71 is such that the occurrence of blockage by large items of litter is minimised.

Also directly behind the rear brush roller 57 and close to the carpet surface is an elongated intake member 72 in the form of a perforated tube, extending across the width of the brush roller 57 and with its axis parallel thereto. This tube is connected by means of a second pipe 73, having a diameter smaller than pipe 69 but positioned generally alongside, to a second motor-driven pump 74, located beside the first pump 71 to a dust collecting bag 75, positioned beside the litter accumulation bag 70 in the vacuum unit. The two pumps 71 and 74 are located in a compartment 76 at the base of the vacuum unit and are separately operable by independent controls (not shown).

The cleaner is also provided with a cable and plug by means of which the motors are electrically connected to the mains supply, and other conventional switches and controls by means of which the motors may be switched on and off, or their speed varied, thus varying the speed of rotation of the brush rollers 57, 58 and the speed of the fan thus varying the flow rate of air flowing through the cleaner. Means (not shown) may also be provided to raise and lower the housing 51 relative to the carpet surface. This may comprise means for raising and lowering the rear support wheels 66 simultaneously relative to the housing by means of a cable control connected to a lever mounted on the handle 53.

The position of the vacuum unit 54 on the handle 53 is chosen so that its weight almost counter-balances the weight of the housing 51 and its contents when the cleaner is rocked backwards or forwards on the rear support wheels 66 thus facilitating use by an operator.

In use the cleaner is controlled by an operator moving it across the surface of the carpet to be cleaned and varying the speeds of the two pumps 71 and 74 and the motor 55 by the controls mounted on the handle 53.

The first pump 71 causes air to be drawn into the compartment at the front of the housing 51 around the two brush rollers 57, 58, through the aperture 68 in the bulkhead 67 at the rear of the compartment, along the larger diameter pipe 69, in to the litter accumulation bag 70 in the vacuum unit and out through vents in the unit cover 60. The second pump 74 causes air to be drawn in to the compartment at the front of the housing 51, through the intake member 72 along the smaller diameter pipe 73, in to the dust collection bag 75 and again out through vents in the cover 60.

The contra-rotating brush rollers 57 and 58, being caused to rotate in the directions shown by the arrows in FIG. 5, brush up dirt, dust, debris, litter, leaves and other particulate material. Under the combined influence of the rollers and the air flow all this matter which has been brushed up passes upwards between the two rollers. Most of it, and in particular the larger items of litter, debris etc, pass through the aperture 57, the pipe 69 to the litter accumulation bag 70. Some dirt and dust particles however escape being entrained in this first air flow but are drawn into the intake member 72, along pipe 73 and into the dust collection bag. The intake member 72 also picks up dirt and dust particles which have been loosened by the brush rollers but have not been drawn between them. Thus the carpet is subjected to a second cleaning action, by this part of the cleaner.

Both the litter accumulation bag 70 and the dust collection bag 75 may be removed readily when full, emptied, cleaned and returned to the vacuum unit 54.

The cleaner may also be used to clean a carpet with dry powder. The powder is first distributed by hand over the carpet surface and then brushed into the carpet pile by passing the cleaner over it with the motors switched off. The cleaner is then passed over the carpet again with all the motors switched on. Most of the powder and dirt is drawn into the litter accumulation bag and the remainder into the dust collection bag.

We claim:

1. A carpet cleaner comprising:

a hollow housing capable of being moved across the carpet surface;

intake means through which dust, dirt, debris, litter and other particulate matter may be ingested;

air exhaust means;

brush means in the vicinity of the intake means for brushing up said dust, dirt, debris, litter and other particulate matter from the carpet surface, said brush means comprises a pair of contra-rotating brush rollers wherein one of the rollers rotates at a speed lower than the speed of the other roller, said roller positioned side by side with axes parallel to one another and to the carpet surface and at right angles to the direction of movement of the cleaner, the arrangement being such that when the rollers rotate in use the dust, dirt, debris, litter and other particulate matter passes between the rollers generally upwardly from the carpet surface;

air flow creation means to induce air to enter through the intake means and exit through the exhaust means;

accumulation means for accumulating the larger items of debris, litter and other particulate matter entrained in the air flow; and, collection means for collecting dust, dirt and other smaller items of particulate matter not accumulated in the accumulation means.

2. A carpet cleaner comprising:

a hollow housing capable of being moved across the carpet surface;

intake means comprising an intake member through which dust, dirt, debris, litter and other particulate matter may be ingested;

air exhaust means;

brush means in the vicinity of the intake means for brushing up said dust, dirt, debris, litter and other particulate matter from the carpet surface said brush means comprises a pair of contra-rotating brush rollers positioned side by side with axes parallel to one another and to the carpet surface and at right angles to the direction of movement of the cleaner, the arrangement being such that when the rollers rotate in use the dust, dirt, debris, litter and other particulate matter passes between the rollers generally upwardly from the carpet surface;

air flow creation means to induce air to enter through the intake means and exit through the exhaust means;

accumulation means for accumulating the larger items of debris, litter and other particulate matter entrained in the air flow; and, collection means for collecting dust, dirt and other smaller items of particulate matter not accumulated in the accumulation means wherein said intake member is connected to the collection means and is near to and at the rear of the rear brush roller, and adjacent the carpet surface, said intake member ingesting dust, dirt and other smaller items of particulate matter to be entrained in the air flow and passed to the collecting means.

3. A carpet cleaner as claimed in claim 2 wherein one of the rollers rotates at a speed lower than the speed of the other roller.

4. A carpet cleaner according to claim 2 wherein the intake member comprises a hollow cylindrical tube with a plurality of apertures adjacent the rear roller through which dust, dirt and other smaller items of particulate matter may pass.

5. A carpet cleaner as claimed in claim 2 wherein the collection means is located downstream of the accumulation means, and the air flows through the accumulation means and then through the collection means.

6. A carpet cleaner as claimed in claim 5 wherein the accumulation means comprises a box and is, in use, positioned immediately adjacent the brush means.

7. A carpet cleaner as claimed in claim 5 wherein the accumulation means has inlet means through which the dust, dirt, debris, litter and other particulate matter brushed up by the brush means is guided by the air flow into the accumulation means.

8. A carpet cleaner as claimed in claim 5 wherein the accumulation means has exit means through which dust, dirt and smaller items of particulate matter entrained in the air flow passes, leaving the litter, debris and larger items of particulate matter in the accumulation means.

9. A carpet cleaner as claimed in claim 8 wherein baffle means is provided at the exit means to prevent said litter, debris and larger items of particulate matter leaving the accumulation means.

10. A carpet cleaner as claimed in claim 9 wherein the baffle means comprises a baffle plate.

11. A carpet cleaner as claimed in claim 8 wherein filter means is provided at the exit means to prevent said litter, debris and larger items of particulate matter leaving the accumulation means.

12. A carpet cleaner as claimed in claim 5 wherein the air flow inducing means is located downstream of the accumulation means.

13. A carpet cleaner as claimed in claim 2 wherein the collection mean comprises a dust collecting bag.

14. A carpet cleaner comprising:

a hollow housing capable of being moved across the carpet surface;

intake means through which dust, dirt, debris, litter and other particulate matter may be ingested;

air exhaust means;

brush means in the vicinity of the intake means for brushing up said dust, dirt, debris, litter and other particulate matter from the carpet surface;

air flow creation means to induce air to enter through the intake means and exit through the exhaust means;

accumulation means for accumulating the larger items of debris, litter and other particulate matter entrained in the air flow; and, collection means for collecting dust, dirt and other smaller items of particulate matter not accumulated in the accumulation means; wherein the air flow creation means creates two air flows, the first air flow entraining mainly larger items of debris, litter and other particulate material to cause said larger items to enter the accumulation means, and the second air flow entraining dust, dirt and other smaller items of particulate matter not entrained in the first air flow to cause said smaller items to enter the collecting means.

15. A carpet cleaner as claimed in claim 14 herein the first air flow entrains said mainly larger items from a location generally above the brush means and the second air flow entrains said dust, dirt and other smaller items of particulate matter from a further location generally to the rear of the brush means.

16. A carpet cleaner as claimed in claim 1 wherein the air flow inducing means comprises fan means.

* * * * *